US012618612B2

(12) United States Patent
Miller

(10) Patent No.: US 12,618,612 B2
(45) Date of Patent: May 5, 2026

(54) REFRIGERATOR APPLIANCE AND VALVE ASSEMBLY

(71) Applicant: Haier US Appliance Solutions, Inc., Wilmington, DE (US)

(72) Inventor: Charles Benjamin Miller, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 28 days.

(21) Appl. No.: 18/734,536

(22) Filed: Jun. 5, 2024

(65) Prior Publication Data

US 2025/0377153 A1 Dec. 11, 2025

(51) Int. Cl.
*F25D 23/02* (2006.01)

(52) U.S. Cl.
CPC ..... *F25D 23/028* (2013.01); *F25D 2323/02* (2013.01); *F25D 2323/122* (2013.01)

(58) Field of Classification Search
CPC ..... F25D 23/028; F25D 2323/02; F25D 2323/122; F16K 27/003; F16K 11/02; F16L 39/00; F16L 37/56
USPC ..... 303/119.3
See application file for complete search history.

(56) References Cited

U.S. PATENT DOCUMENTS 7,159,406 B2 * 1/2007 Schuchart ..... F25D 23/126 62/340
7,934,695 B2 5/2011 Sim et al.
8,028,534 B2 10/2011 Jenkins, Jr. et al.
8,240,159 B2 8/2012 Prabhakar et al.
2002/0163187 A1 * 11/2002 Pelfrey ..... F16L 37/0927 285/124.1
2012/0111048 A1 * 5/2012 Kim ..... F25C 1/10 62/340
2013/0134702 A1 * 5/2013 Boraas ..... F16L 37/23 285/120.1
2018/0347884 A1 * 12/2018 Kang ..... F16K 11/24

FOREIGN PATENT DOCUMENTS

CN 102213530 A 10/2011
CN 102466386 B 11/2013

* cited by examiner

*Primary Examiner* — Cassey D Bauer
(74) *Attorney, Agent, or Firm* — Dority & Manning, P.A.

(57) ABSTRACT

A refrigerator appliance includes a cabinet and a door having an ice maker apparatus. A plurality of valves includes a solenoid and release fitting. A mount member couples together the plurality of valves. The release fitting is configured to articulate along a translation axis to selectively couple the plurality of valves through a valve opening to a plurality of conduits. A fluid manifold couples the plurality of valves together in fluid communication. A release plate includes an opening through which the plurality of conduits is extendable in selective fluid coupling to the plurality of valves. The release plate includes a slot into which the mount member extends to couple the mount member to the release plate. The slot extends along the translation axis to permit movement of the release plate relative to the plurality of valves.

19 Claims, 11 Drawing Sheets

REFRIGERATOR APPLIANCE AND VALVE ASSEMBLY

FIELD OF THE INVENTION

The present disclosure is related generally to refrigerator appliances.

BACKGROUND OF THE INVENTION

Refrigerator appliances generally include a refrigeration chamber and a freezer chamber. A dispenser may be included and configured to dispense ice and/or water to a user, such as a user's container. Dispensers may be positioned at a door or a panel at a refrigerator appliance casing. Dispensers may generally be recessed into the door or the panel.

In side-by-side refrigerators, the ice maker and the water dispenser are often mounted in the freezer door. The water valves that supply the ice maker and the water dispenser are typically mounted in the cabinet of the refrigerator, which generally requires each water supply and drain line to pass into the door. For instance, the water supply line may pass through door hinges. However, such arrangement is cumbersome, increases installation time through the doors and cabinet, and may limit a quantity of water lines that may pass between the door and cabinet.

A refrigerator appliance that addresses one or more of these issues would be beneficial and advantageous.

BRIEF DESCRIPTION OF THE INVENTION

Aspects and advantages of the invention will be set forth in part in the following description, or may be apparent from the description, or may be learned through practice of the invention.

An aspect of the present disclosure is directed to a refrigerator appliance including a cabinet and a door attachable to the cabinet. The door is configured to allow selective entry to a refrigeration compartment, a freezer compartment, or both, at the cabinet. The door includes an ice maker apparatus. A plurality of valves includes a solenoid and release fitting. A mount member couples together the plurality of valves. The release fitting is configured to articulate along a translation axis to selectively couple the plurality of valves through a valve opening to a plurality of conduits. A fluid manifold couples the plurality of valves together in fluid communication. A release plate includes an opening through which the plurality of conduits is extendable in selective fluid coupling to the plurality of valves. The release plate includes a slot into which the mount member extends to couple the mount member to the release plate. The slot extends along the translation axis to permit movement of the release plate relative to the plurality of valves.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
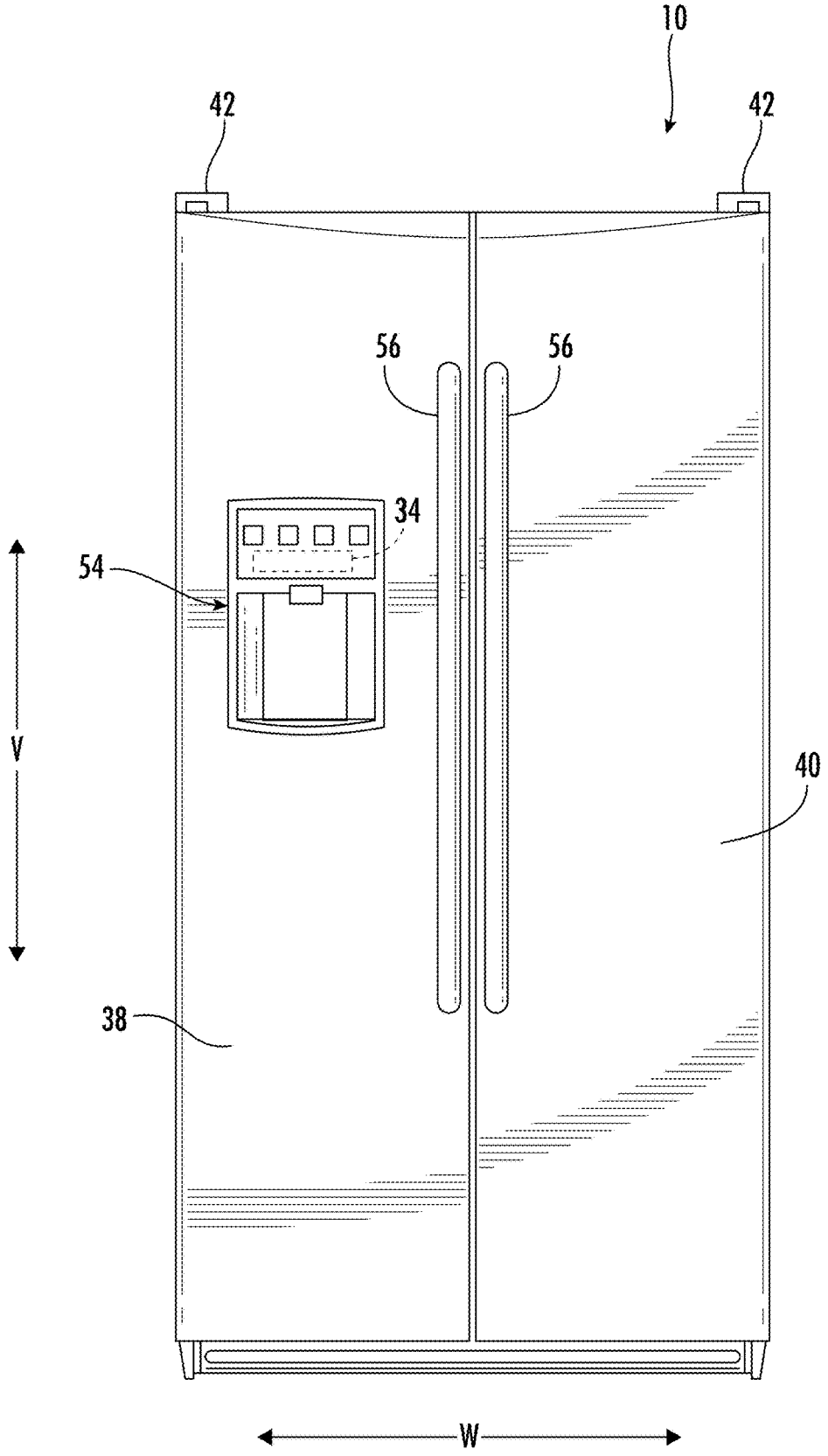
FIG. 1 is a perspective view of a refrigerator appliance according to an exemplary embodiment of the present subject matter with doors of the example refrigerator appliance shown closed.

Repeat use of reference characters in the present specification and drawings is intended to represent the same or analogous features or elements of the present invention.

DETAILED DESCRIPTION

Reference now will be made in detail to embodiments of the present invention, one or more examples of which are illustrated in the drawings. The word "exemplary" is used herein to mean "serving as an example, instance, or illustration." Any implementation described herein as "exemplary" is not necessarily to be construed as preferred or advantageous over other implementations. Moreover, each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents. The detailed description uses numerical and letter designations to refer to features in the drawings. Like or similar designations in the drawings and description have been used to refer to like or similar parts of the invention.

As used herein, the terms "first", "second", and "third" may be used interchangeably to distinguish one component from another and are not intended to signify location or importance of the individual components. The singular forms "a," "an," and "the" include plural references unless the context clearly dictates otherwise. The terms "coupled," "fixed," "attached to," and the like refer to both direct coupling, fixing, or attaching, as well as indirect coupling, fixing, or attaching through one or more intermediate components or features, unless otherwise specified herein. As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Terms of approximation, such as "about," "generally," "approximately," or "substantially," include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Benefits, other advantages, and solutions to problems are described below with regard to specific embodiments. However, the benefits, advantages, solutions to problems, and any feature(s) that may cause any benefit, advantage, or solution to occur or become more pronounced are not to be construed as a critical, required, or essential feature of any or all the claims.

Figure 2:
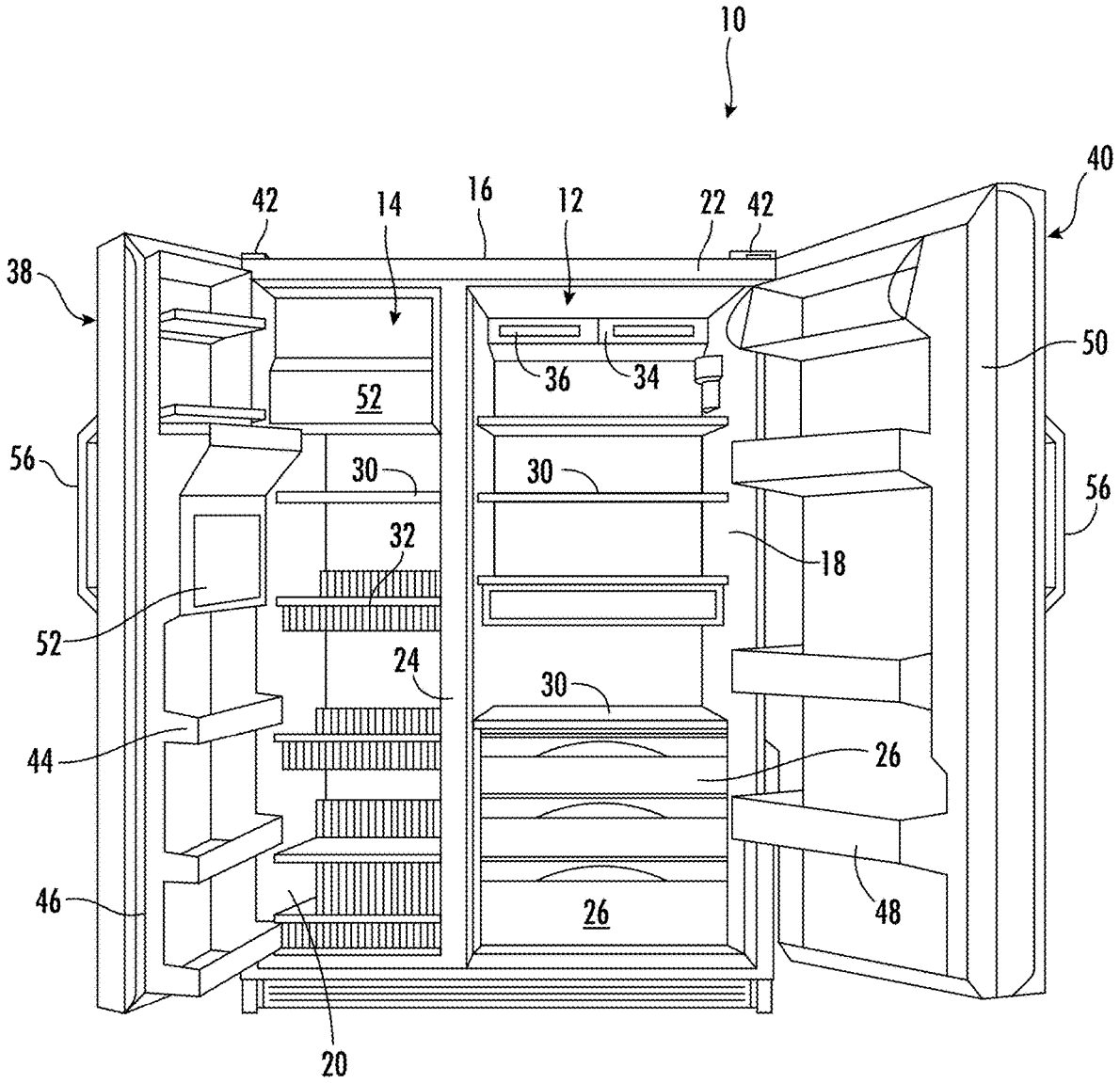
FIG. 2 is a perspective view of the exemplary refrigerator appliance with doors shown open.
Figure 3C:
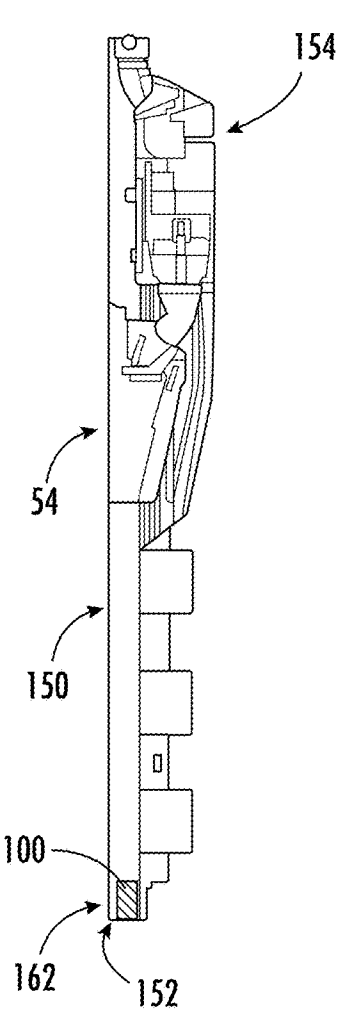
FIG. 3C is a side view of the exemplary door of FIG. 3A in accordance with aspects of the present disclosure.
Figure 3B:
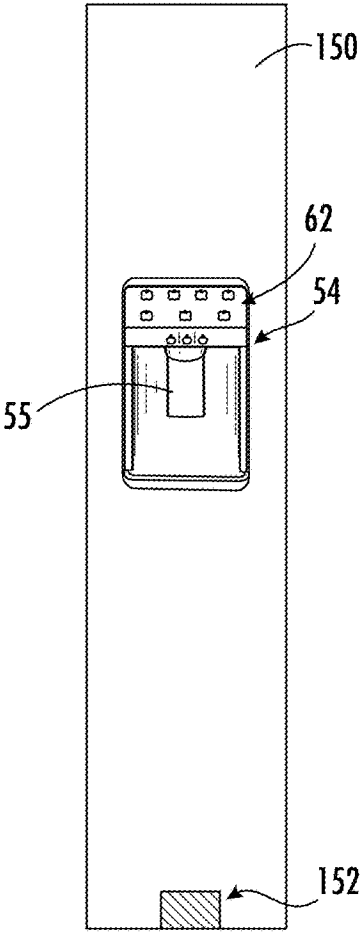
FIG. 3B is an external view of the exemplary door of FIG. 3A in accordance with aspects of the present disclosure.
Figure 3A:
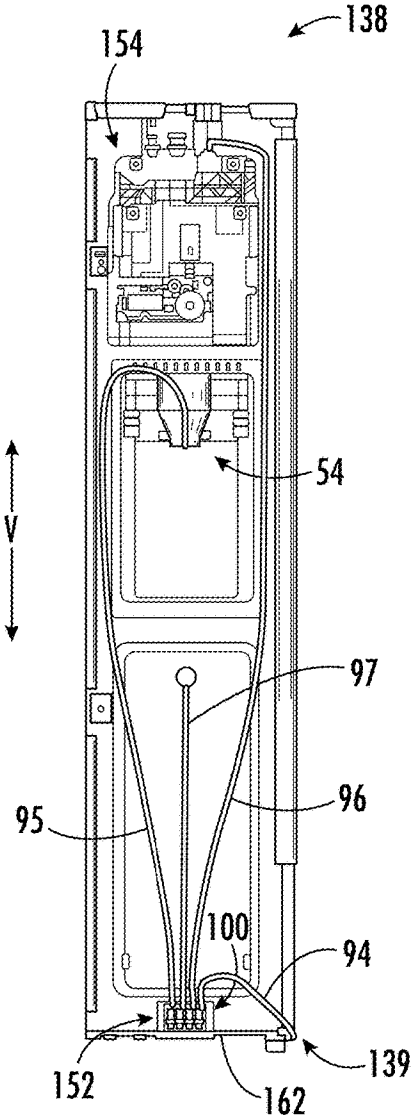
FIG. 3A is an internal view of an exemplary door of a refrigerator appliance including an embodiment of a valve assembly in accordance with aspects of the present disclosure.
Figure 4C:
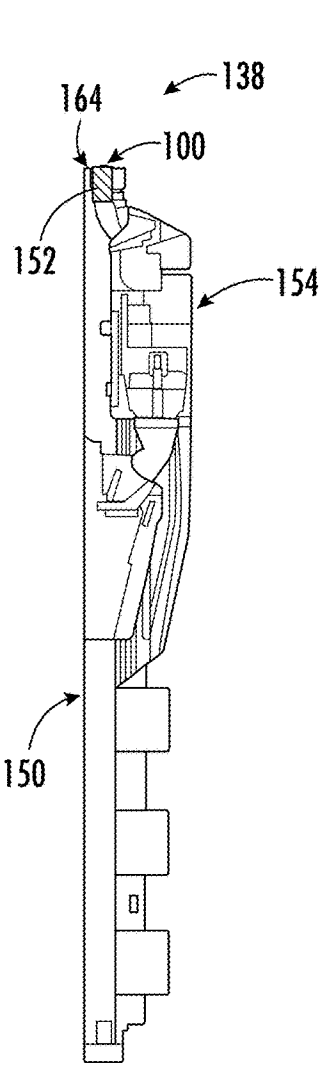
FIG. 4C is a side view of the exemplary door of FIG. 4A in accordance with aspects of the present disclosure.
Figure 4B:
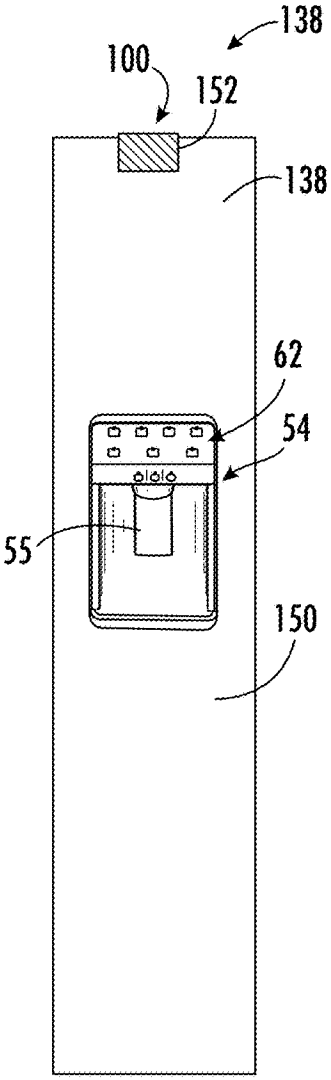
FIG. 4B is an external view of the exemplary door of FIG. 4A in accordance with aspects of the present disclosure.
Figure 4A:
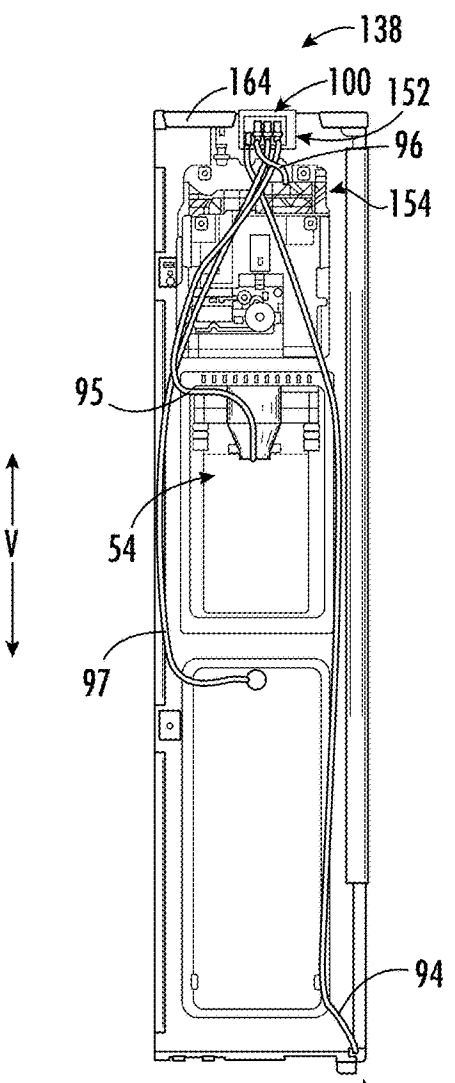
FIG. 4A is an internal view of an exemplary door of a refrigerator appliance including an embodiment of a valve assembly in accordance with aspects of the present disclosure.
Figure 5C:
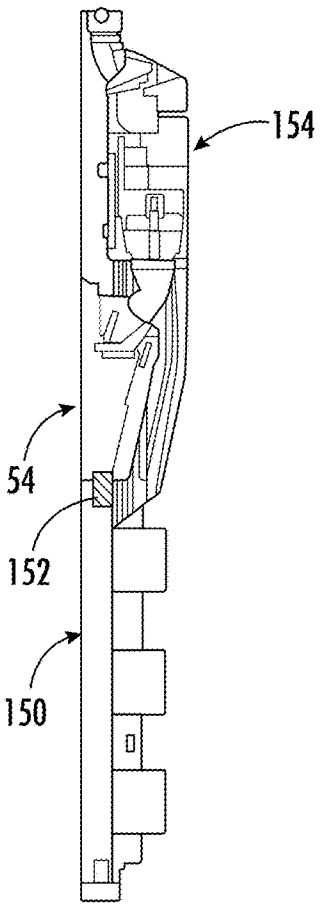
FIG. 5C is a side view of the exemplary door of FIG. 5A in accordance with aspects of the present disclosure.
Figure 5B:
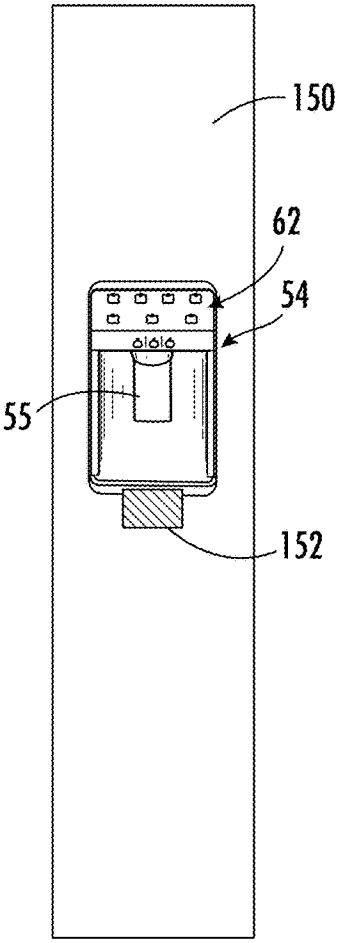
FIG. 5B is an external view of the exemplary door of FIG. 5A in accordance with aspects of the present disclosure.
Figure 5A:
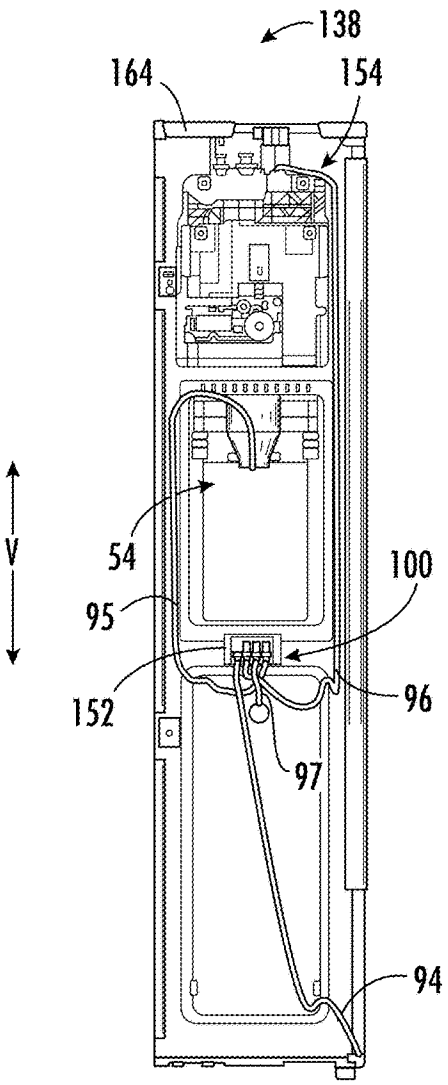
FIG. 5A is an internal view of an exemplary door of a refrigerator appliance including an embodiment of a valve assembly in accordance with aspects of the present disclosure.
Figure 7:
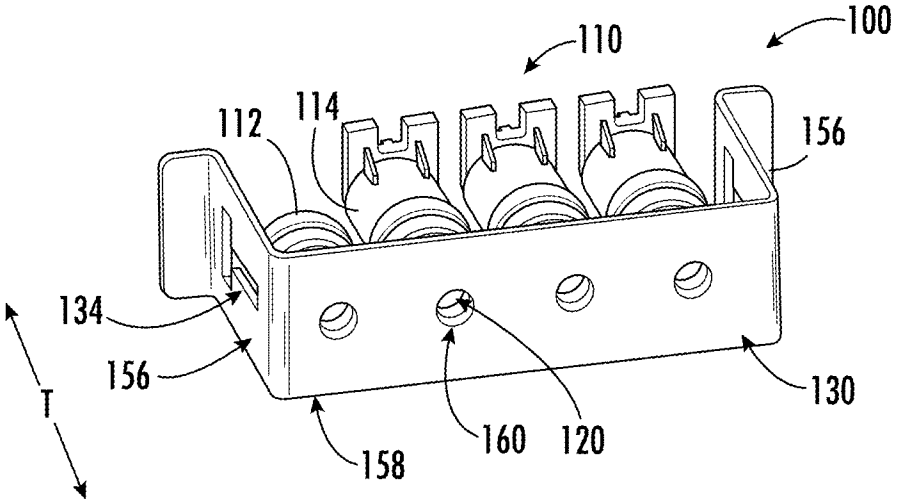
FIG. 7 is a perspective view of an exemplary embodiment of the valve assembly of FIG. 6 in accordance with aspects of the present disclosure.
Figure 6:
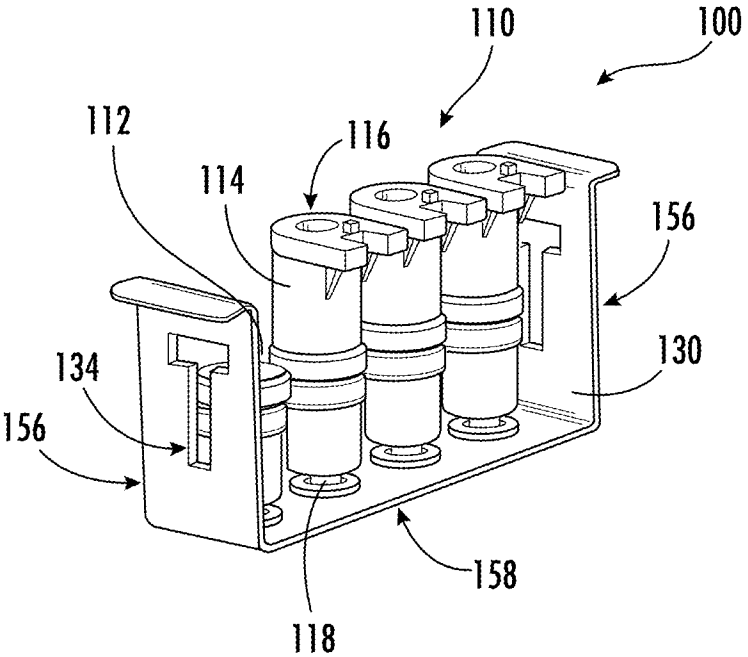
FIG. 6 is a perspective view of an exemplary embodiment of a valve assembly in accordance with aspects of the present disclosure.

FIG. 1 provides a perspective view of a refrigerator appliance 10 according to an exemplary embodiment of the present subject matter. FIG. 2 provides a perspective view of the refrigerator appliance 10 with doors 38, 40 open to view refrigeration and freezer compartments 12, 14 formed within a cabinet or outer case 16. FIG. 1 provides a reference vertical direction V and width direction W.

Referring to FIG. 2, refrigerator appliance 10 includes the refrigeration compartment 12 and the freezer compartment 14, with the compartments arranged side-by-side and contained within the outer case 16. Outer case 16 and inner liners 18 and 20 are generally molded from a suitable plastic or foam material. For instance, the outer case may form a molded plastic or foam outer case. Thus, refrigerator appliance 10 is generally referred to as a side-by-side style refrigerator appliance. In alternative exemplary embodiments, refrigerator appliance 10 may include a single liner and a mullion that spans between opposite sides of the single liner to divide it into the freezer compartment 14, such as a compartment configured for frozen foods, and the refrigeration compartment 12, such as a compartment configured for fresh foods. Outer case 16 is normally formed by folding a sheet of a suitable material, such as pre-painted steel, into an inverted U-shape to form top and side walls of outer case 16. A bottom wall of outer case 16 normally is formed separately and attached to the case side walls and to a bottom frame that provides support for refrigerator appliance 10. However, it should be appreciated that outer case 16 may be formed by other suitable manufacturing methods.

A breaker strip 22 extends between a case front flange and outer front edges of inner liners 18 and 20. Breaker strip 22 is formed from a suitable resilient material, such as an extruded acrylo-butadiene-styrene based material (commonly referred to as ABS). The insulation in the space between inner liners 18 and 20 is covered by another strip of suitable resilient material, which also commonly is referred to as a mullion 24 and may be formed of an extruded ABS material. Breaker strip 22 and mullion 24 may form a front face and extend completely around inner peripheral edges of outer case 16 and vertically between inner liners 18 and 20.

Slide-out drawers 26 and shelves 30 are normally provided in refrigeration compartment 12 to support items being stored therein. In addition, a shelf 30, a basket 32, or both, are generally provided in freezer compartment 14.

Refrigerator appliance features are regulated with a controller 34 according to user preference via manipulation of a control interface 36 mounted in an upper region of refrigeration compartment 12 and coupled to controller 34. Input/output ("I/O") signals may be routed between controller 34 and various operational components of refrigerator appliance 10. The components of refrigerator appliance 10 may be in communication with controller 34 via one or more signal lines or shared communication busses.

Controller 34 can be any device that includes one or more processors and a memory. As an example, in some embodiments, controller 34 may be a single board computer (SBC). For example, controller 34 can be a single System-On-Chip (SOC). However, any form of controller 34 may also be used to perform the present subject matter. The processor(s) can be any suitable processing device, such as a microprocessor, microcontroller, integrated circuit, or other suitable processing devices or combinations thereof. The memory can include any suitable storage media, including, but not limited to, non-transitory computer-readable media, RAM, ROM, hard drives, flash drives, accessible databases, or other memory devices. The memory can store information accessible by processor(s), including instructions that can be executed by processor(s) to perform aspects of the present disclosure.

Referring to FIGS. 1-2, a freezer door 38 and a fresh food door 40 close access openings to freezer compartment 14 and refrigeration compartment 12. Freezer door and fresh food door 38 and 40 are each mounted by a top hinge 42 and a bottom hinge (not shown) to rotate about its outer vertical edge between an open position, as shown in FIG. 1, and a closed position. Freezer door 38 may include a plurality of storage shelves 44 and a sealing gasket 46, and fresh food door 40 also includes a plurality of storage shelves 48 and a sealing gasket 50.

Freezer compartment 14 may include an automatic ice maker 52 and a dispenser assembly 54 provided in freezer door 38 such that ice and/or chilled water can be dispensed without opening freezer door 38. Freezer door and fresh food door 38 and 40 may be opened by handles 56. It should be appreciated that the dispenser assembly 54 may be positioned at an exterior portion of the door, such as depicted in FIG. 1, or positioned in an interior portion, such as to require opening the door to access the dispenser assembly 54.

Refrigerator appliance 10 also includes a machinery compartment (not shown) that at least partially contains a cooling system including components for executing a known vapor compression cycle for cooling air. The cooling system may include a compressor, a condenser, an expansion device, and an evaporator connected in series as a loop and charged with a refrigerant. The evaporator is a type of heat exchanger which transfers heat from air passing over the evaporator to the refrigerant flowing through the evaporator, thereby causing the refrigerant to vaporize. The cooled air is used to refrigerate one or more refrigerator or freezer compartments via fans. Also, a cooling loop can be added to direct cool the ice maker to form ice cubes, and a heating loop can be added to help remove ice from the ice maker. Collectively, the vapor compression cycle components in a refrigeration circuit, associated fans, and associated compartments are conventionally referred to as a sealed system. The construction and operation of the sealed system are well known to those skilled in the art.

Referring to FIGS. 3A-3C, FIGS. 4A-4C, and FIG. 5A-5C, a dispenser assembly 54 at the door may include a control panel 62 providing a display screen and a control interface 64, such as buttons, knobs, levers, or other interfaces at which a user may select one or more functions of the dispenser assembly 54. Functions may include, but not limited to, dispensing ice, selecting a type of ice to be dispensed (e.g., crushed or cubed), dispensing fluid (e.g., water), operating a light, etc. Control interface 64 may provide messages, such as, but not limited to, temperature, filter status, lock controls, etc.

The dispenser assembly 54 may include a dispenser control interface 55, such as a dispenser panel, configured to release ice or fluid when articulated. For instance, a user may position a container onto the dispenser control interface 55 to command release of ice or fluid from the dispenser assembly 54.

As generally understood, the dispenser assembly 54 may generally include a mouth forming, at least in part, an outlet opening for water and ice. The mouth may generally be positioned within a recess 76, and a drain is positioned within the recess and below the mouth, such as to receive fluid or ice that may fall thereinto.

Referring to FIGS. 3A-3C, FIGS. 4A-4C, and FIG. 5A-5C, embodiments of the refrigerator appliance 10 include a door 138 including a valve assembly 100. The door 138 may include one or both of doors 38, 40 depicted and described in regard to FIGS. 1-2. For instance, door 138 may correspond to freezer door 38. In various embodiments, such as described herein, door 138 may be configured with valve assembly 100 to include and provide a water inlet conduit to the valve assembly 100, and one or more supply conduits, such as for one or more icemakers and/or one or more water or fluid dispensers. In various embodiments, door 138 includes a plenum 152 positioned at a bottom end cap 162 of the door 138 (e.g., depicted in FIGS. 3A-3C), a top end cap 164 of the door 138 (e.g., depicted in FIGS. 4A-4C), or at the ice maker apparatus 52 (e.g., depicted in FIGS. 5A-5C).

Referring still to FIGS. 3A-3C, FIGS. 4A-4C, and FIG. 5A-5C, door 138 may generally include an exterior surface 150 forming an outer face of the door 138. The ice maker apparatus 52 may include any one or more configurations of fluid dispenser (e.g., water dispenser), ice dispenser, lighting components, user interfaces, and/or controls, such as generally understood. An interior volume at the door 138 includes systems for forming ice, such as one or more ice maker assemblies 154.

Referring to FIGS. 6-10, views depicting an exemplary embodiment of the valve assembly 100 are provided. The valve assembly 100 includes a plurality of valves 110. The valve 110 includes a release fitting 118 configured to selectively permit coupling of a water conduit or tube to the valve 110, such as by articulation along a translation axis T. The release fitting 118 may include a collet, collar, ring, flange, socket, or segmented band. The release fitting 118 may form a quick-release fitting, such as a quick-connect or quick disconnect fitting, such as may generally be understood. The translation axis T may correspond to the vertical direction V at the refrigerator appliance 10. However, it should be appreciated that the translation axis T may correspond to the width direction W, or depth direction orthogonal to the vertical and width directions.

The plurality of valves 110 include a solenoid 114. The solenoid 114 includes an electrical connection 116 at which an electrical line may be attached to provide power to operate the solenoid 114.

A fluid opening 120 is positioned through the valve 110 to permit ingress and egress of fluid, such as water, to or from the valve 110. A manifold 122 extends in fluid communication between the valves 110. Manifold 122 forms an internal flow passage 123 providing fluid communication along the plurality of valves 110. For instance, a first valve 110A (FIG. 11B) may be operably coupled to the main water supply conduit 94 to receive water. One or more second valves 110B (FIG. 11B) may be operably coupled to system supply conduits (e.g., dispenser or icemaker supply conduits 95, 96, 97) configured to receive water through the manifold 122 from the first valve 110 and provide the water to respective systems (e.g., one or more icemakers, dispensers, etc.).

Referring still to FIGS. 6-10, a release plate 130 is configured to retain the plurality of valves 110. A mount member 132 is attachable to the valve 110, such as at an outer housing 112 or at the solenoid 114. The mount member 132 is attachable to the release plate 130 at an elongated opening or slot 134. A portion 136 of the mount member 132 is extendable into the slot 134 to retain the mount member 132 at the release plate 130. In various embodiments, the slot 134 extends substantially along the translation axis T, such as to allow for selectively movement or articulation of the mount member 132 along translation axis T.

Figure 9:
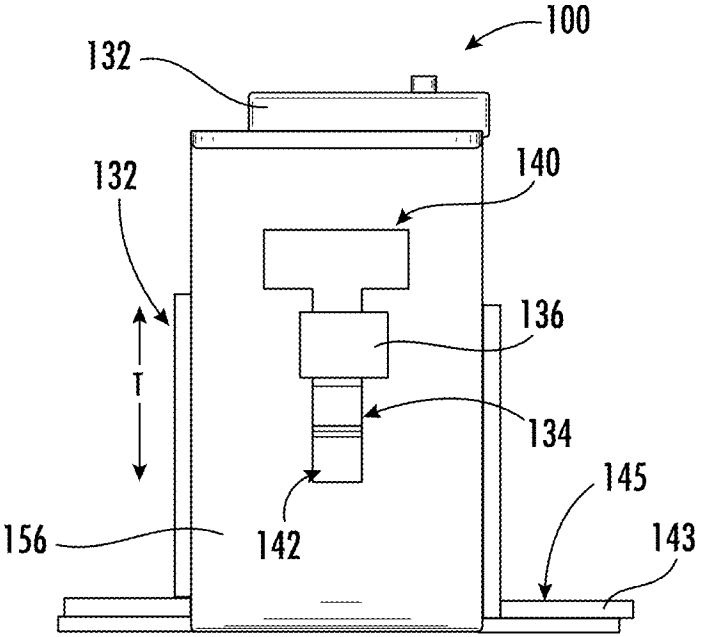
FIG. 9 is a side view of an exemplary embodiment of the valve assembly of FIG. 8A in accordance with aspects of the present disclosure.

Referring briefly to FIG. 9, in some embodiments, the slot 134 may include an insertion portion 140 into which the portion 136 of the mount member 132 is extendable. The insertion portion 140 may extend substantially perpendicular to a travel portion 142. The travel portion 142 may extend substantially along the translation axis T, such as co-directional to an articulation of the release fitting 118 at the valve 110. The portion 136 of the mount member 132 extending through the release plate 130 may form a larger body corresponding to the insertion portion 140 than a neck corresponding to the travel portion 142.

In various embodiments, the release plate 130 includes a sidewall 156 extending substantially along the translation axis T. The release plate 130 may include a pair of sidewalls 156 between which the plurality of valves 110 are positioned. The mount member 132 may extend between slots 134 positioned through the sidewalls 156. For instance, the portion 136 of the mount member 132 may extend through the slot 134 at the sidewall 156. A base wall 158 extends between the sidewalls 156. In some embodiments, a base wall opening 160 extends through the base wall 158. The opening 160, or plurality thereof, may correspond to the fluid opening 120 at the valve 110.

Embodiments of the release plate 130 are configured to permit movement of the release plate 130 along the translation axis T and facilitate compact packaging and close spacing of the plurality of valves 110. For instance, the plurality of valves 110 may include a first valve or water supply valve fluidly coupled to main water supply conduit 94, and a plurality of second valves or system supply valves fluidly coupled to supply conduits 95, 96, 97. For instance, the plurality of valves 110 may include a supply valve and one, or two, or three, or more system supply valves. The manifold 122 provides a flow channel providing fluid communication from the main water supply conduit 94 and first valve to the one or more conduits 95, 96, 97 and second valves to systems such as the dispenser assembly 54, or first or second ice maker assemblies 52, 154. The release plate 130 is translatable along the translation axis T to selectively force onto and articulate the release fitting 118 to release a barb and facilitate removal of the terminal end 91 of the conduit from the valves 110. In various embodiments, the release plate 130 promotes simultaneous de-coupling of the plurality of valves 110 from the plurality of conduits 94, 95, 96, 97. The valve assembly 100 including the release plate 130 such as provided herein may promote installation, access, removal, and compact positioning of the plurality of valves 110 and conduits 90 at the refrigerator appliance 10.

Figure 8A:
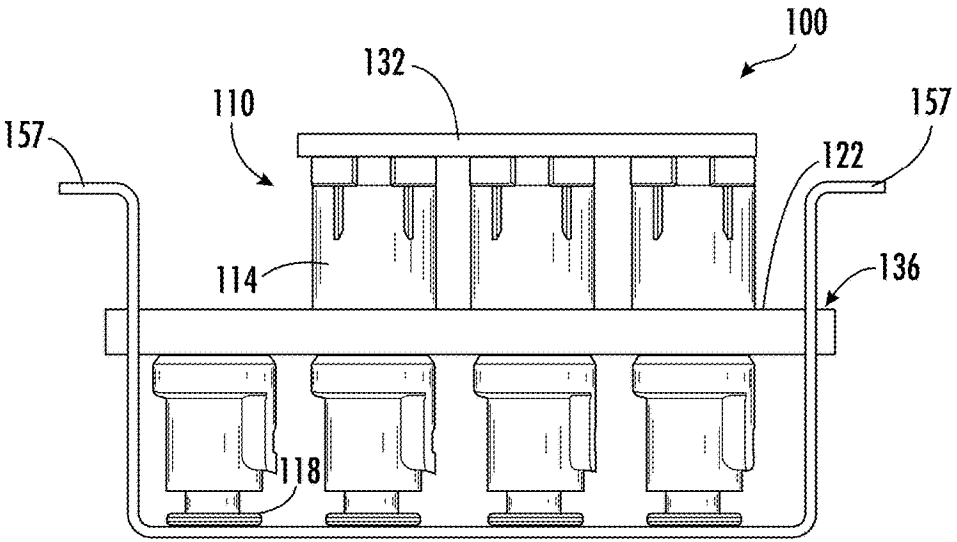
FIG. 8A is a side view of an exemplary embodiment of the valve assembly in accordance with aspects of the present disclosure.
Figure 8C:
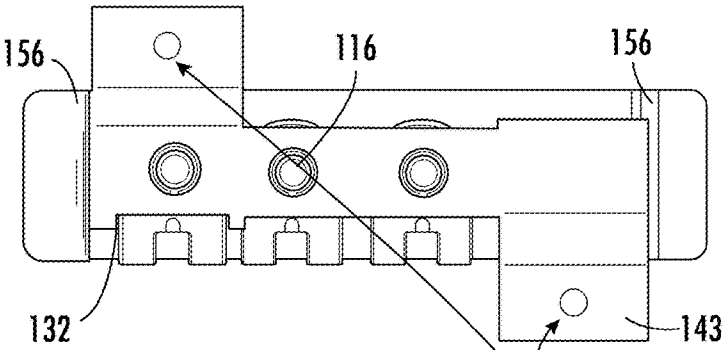
FIG. 8C is a top view of an exemplary embodiment of the valve assembly in accordance with aspects of the present disclosure.
Figure 8B:
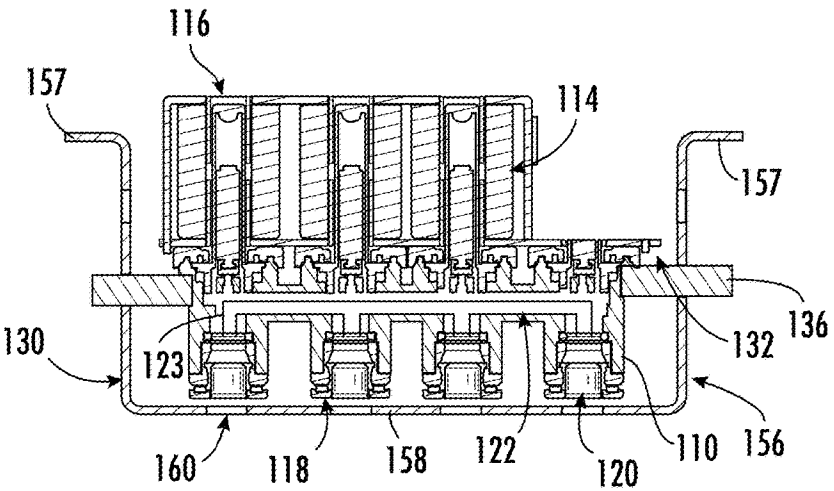
FIG. 8B is a side cross-sectional view of an exemplary embodiment of the valve assembly in accordance with aspects of the present disclosure.
Figure 10:
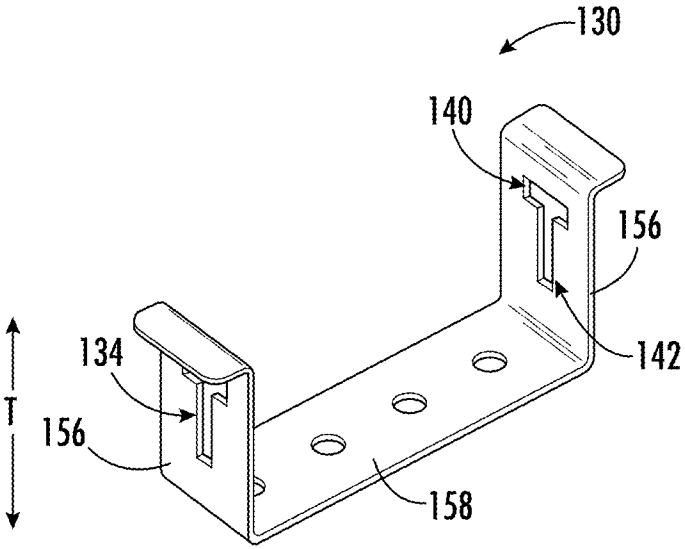
FIG. 10 is a perspective view of an exemplary embodiment of a portion of the valve assembly in accordance with aspects of the present disclosure.

Referring to FIG. 8C, in some embodiments, the mount member 132 includes a mount interface 143, such as a tab or platform, and a fastener opening 145. Fastener opening 145 may be configured to receive a mechanical fastener (e.g., bolt, screw, threaded shank generally, etc.) to couple to a fixed member at the refrigerator appliance 10, such as at door 138.

Referring back to FIGS. 3A-3C, FIGS. 4A-4C, and FIG. 5A-5C, and further referring to FIGS. 11A-11B and FIGS. 12A-12B, the door 138 may include a housing 166 at which the plenum 152 is positioned. In various embodiments, the housing 166 includes walls forming the plenum 152 as a pocket, recess, or volume. The release plate 130 is positioned at the plenum 152, such as within the housing 166.

Figure 11B:
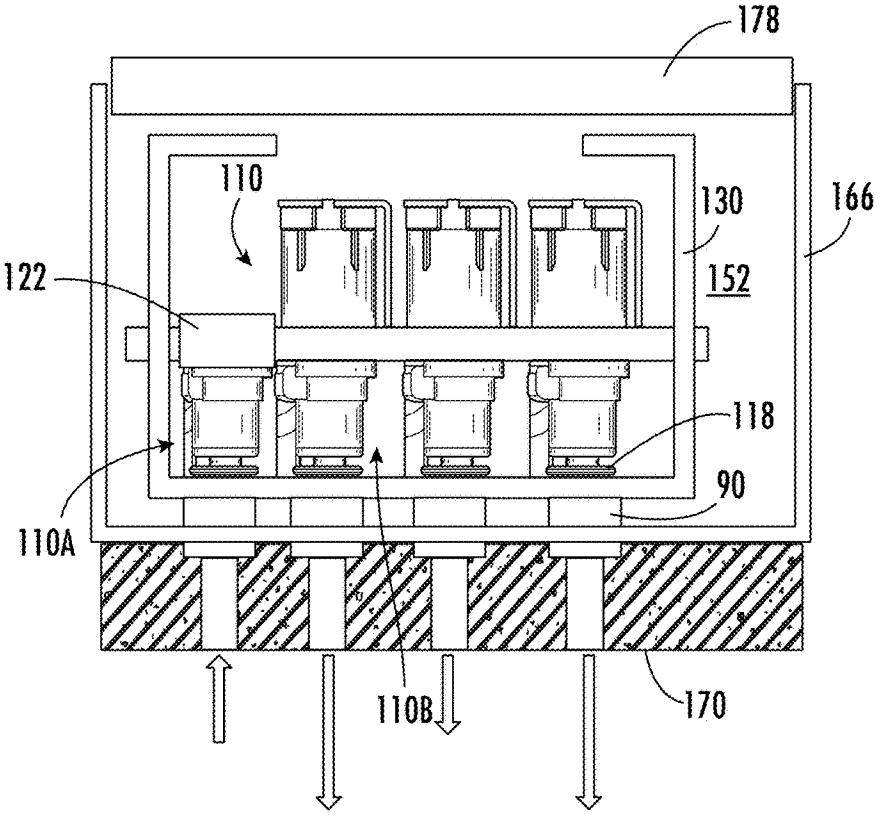
FIG. 11B provides an assembled view of the exemplary valve assembly to the door of FIG. 11A in accordance with aspects of the present disclosure.
Figure 11A:
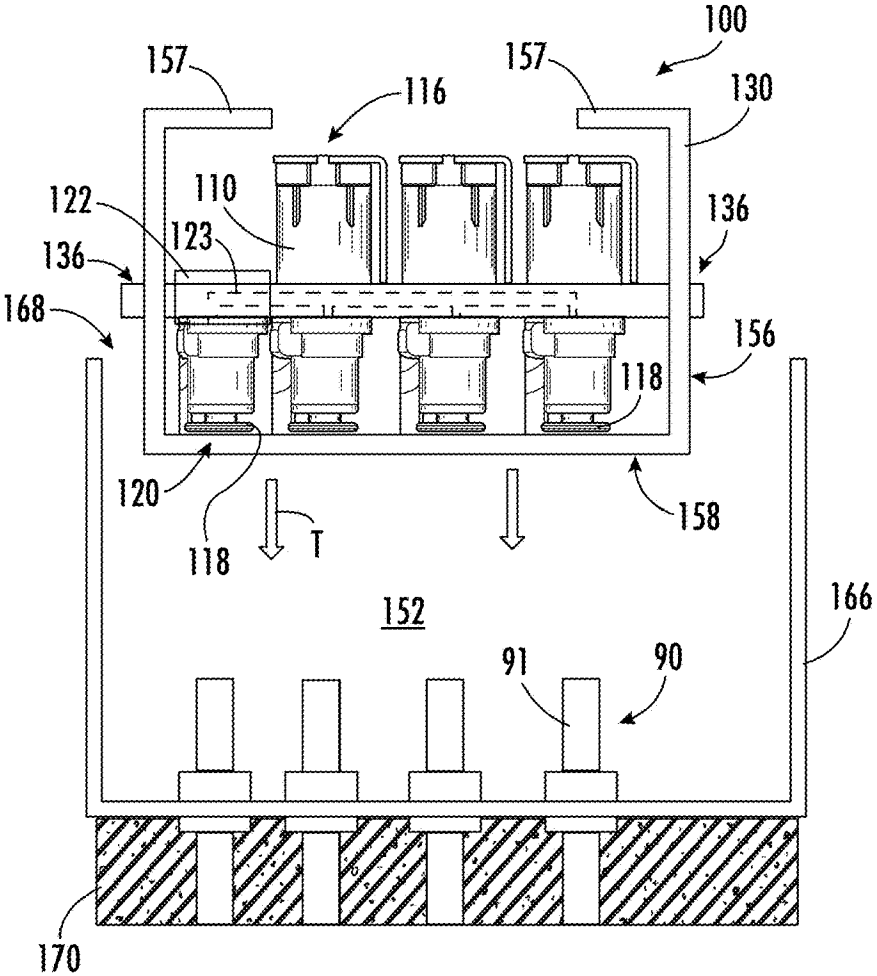
FIG. 11A depicts an exemplary method for positioning an exemplary embodiment of a valve assembly at an exemplary portion of a door for a refrigerator appliance in accordance with aspects of the present disclosure.

The housing 166 includes an open face 168 through which the release plate 130 is receivable into the plenum 152. In some embodiments, the open face 168 may correspond to an upper face along the translation axis T, such as to facilitate a user positioning the release plate 130 into the plenum 152 from along the translation axis T or vertical direction V. A cover 178 may be positioned at the housing 166 to close the open face 168, such as depicted at FIG. 11B. The cover 178 may include a foam seal, plastic, or other appropriate covering, such as to fluidly separate the plenum 152 from a volume outside of the housing 166.

In various embodiments, the door 138 includes a keyway 172 at which a plurality of conduits 90 is received and retained. The plurality of conduits 90 includes one or more water inlet conduits or water supply conduits, such as to provide water to the dispenser assembly 54, one or more ice maker assemblies 154, or both.

In various embodiments, a terminal end 91 of the conduits 90 extends into the plenum 152. Referring to FIGS. 13A-13D, in various embodiments, the housing 166 includes the keyway 172 through which the conduit 90 extends. The release plate 130, with the plurality of valves 110 articulatable with the release plate 130 such as described herein, is positioned in the plenum 152 to fluidly couple the terminal end 91 of the conduit 90 through opening 160 at the release plate 130 and into opening 120 at the valves 110. For instance, referring to FIGS. 11A-11B and FIGS. 12A-12B, the release plate 130 and valves 110 are receivable into the plenum 152 along the translation axis T (e.g., along the vertical direction V of the refrigerator appliance 10). The plurality of conduits 90 extend into the plenum 152 are fluidly coupled to respective valves 110.

Referring to FIGS. 13A-13D, steps of a method for positioning the plurality of conduits 90 is provided. In some embodiments, the keyway 172 includes a keyway opening 174 and a keyway slot 176. The keyway opening 174 permits extension of the plurality of conduits 90, or respective conduits, through the keyway opening 174. For instance, a cross-sectional area of the keyway opening 174 may correspond substantially to a maximum cross-sectional area of the conduit 90.

The plurality of conduits 90 is translated into the keyway slot 176 to retain the plurality of conduits 90. For instance, FIGS. 13A-13D may depict a top-down view of the conduits 90 at the housing 166. The conduits 90 may be translated substantially perpendicular to the translation axis T, such as along a width direction W or a lateral direction.

Figure 13C:
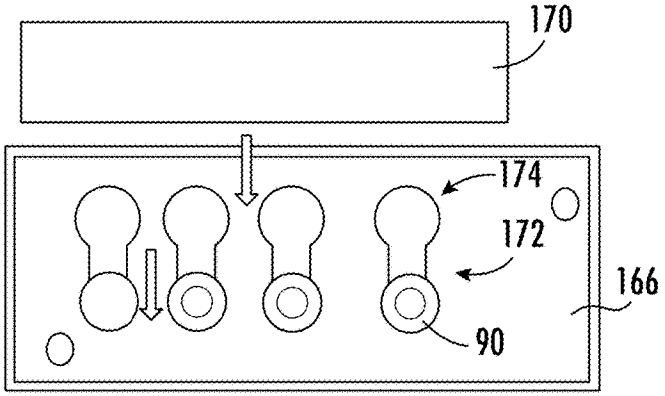
FIG. 13C provides a plan view of an exemplary method for positioning a conduit of a refrigerator appliance at the door in accordance with aspects of the present disclosure.
Figure 13D:
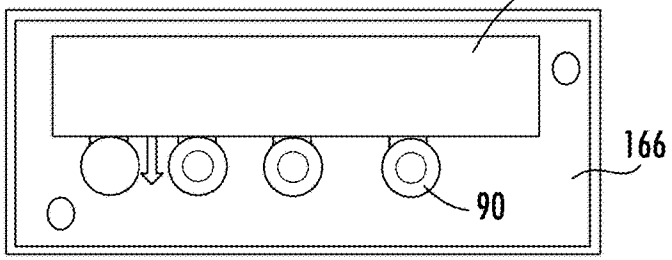
FIG. 13D provides a plan view of an exemplary method for positioning a conduit of a refrigerator appliance at the door in accordance with aspects of the present disclosure.
Figure 13A:
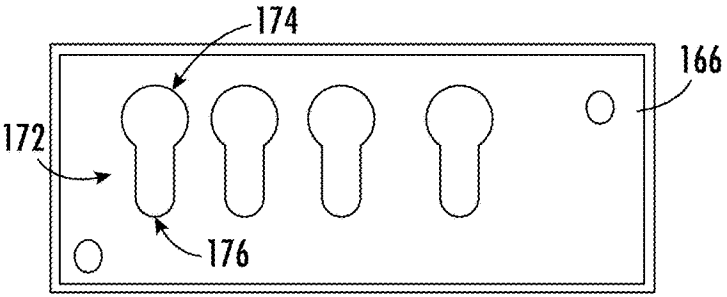
FIG. 13A provides a plan view of an exemplary portion of a door of a refrigerator appliance in accordance with aspects of the present disclosure.
Figure 13B:
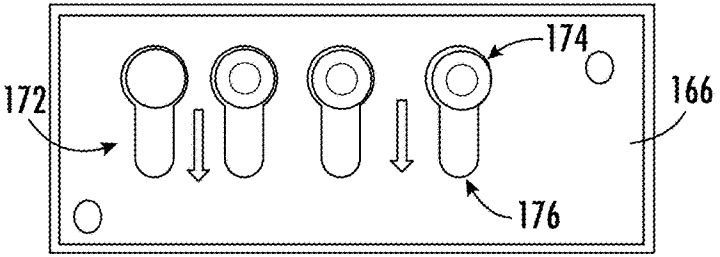
FIG. 13B provides a plan view of an exemplary method for positioning a conduit of a refrigerator appliance at the door in accordance with aspects of the present disclosure.
Figure 13E:
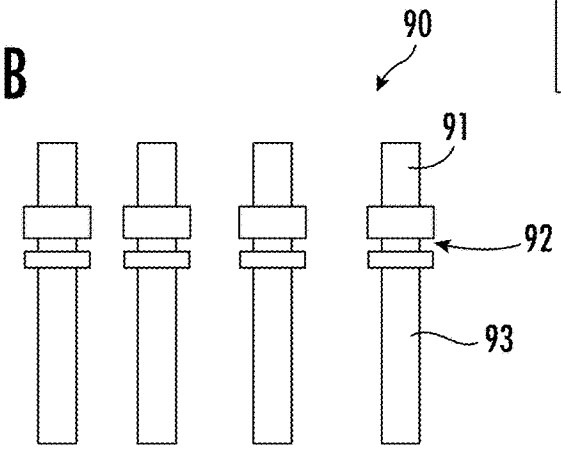
FIG. 13E provides a side view of an exemplary conduit of the refrigerator appliance in accordance with aspects of the present disclosure.

Referring briefly to FIG. 13E, in some embodiments, the conduit 90 may include a retention groove 92. The retention groove 92 may be positioned between the terminal end 91 and a tube body 93 of the conduit 90. The retention groove 92 may be positioned at the housing 166, such as at the keyway 172, to retain a position of the conduit 90 at the plenum 152.

Referring to FIGS. 13C-13D, in various embodiments, a seal 170 may be positioned outside of the housing 166 to obscure the keyway opening 174 when the plurality of conduits 90 is positioned in the keyway slot 176. The seal 170 may include a foam body positioned adjacent to the housing 166 outside of the plenum 152. For instance, the foam body may be insulation foam at the door 138.

Figure 12B:
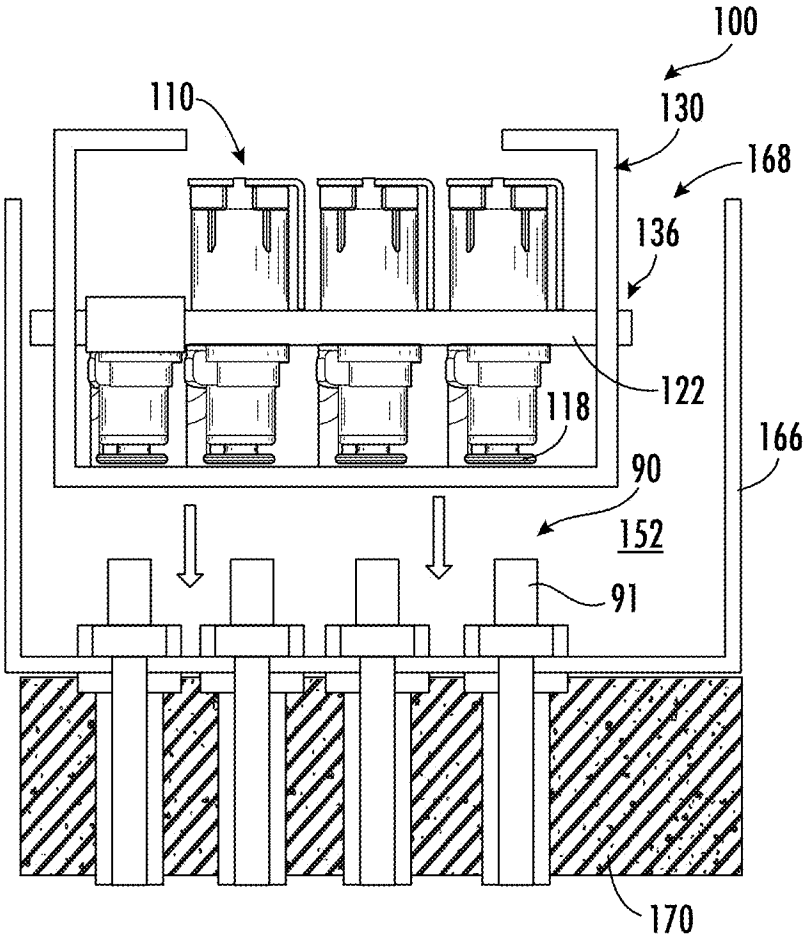
FIG. 12B depicts an exemplary method for positioning the exemplary embodiment of the valve assembly at the door of FIG. 12A in accordance with aspects of the present disclosure.
Figure 12A:
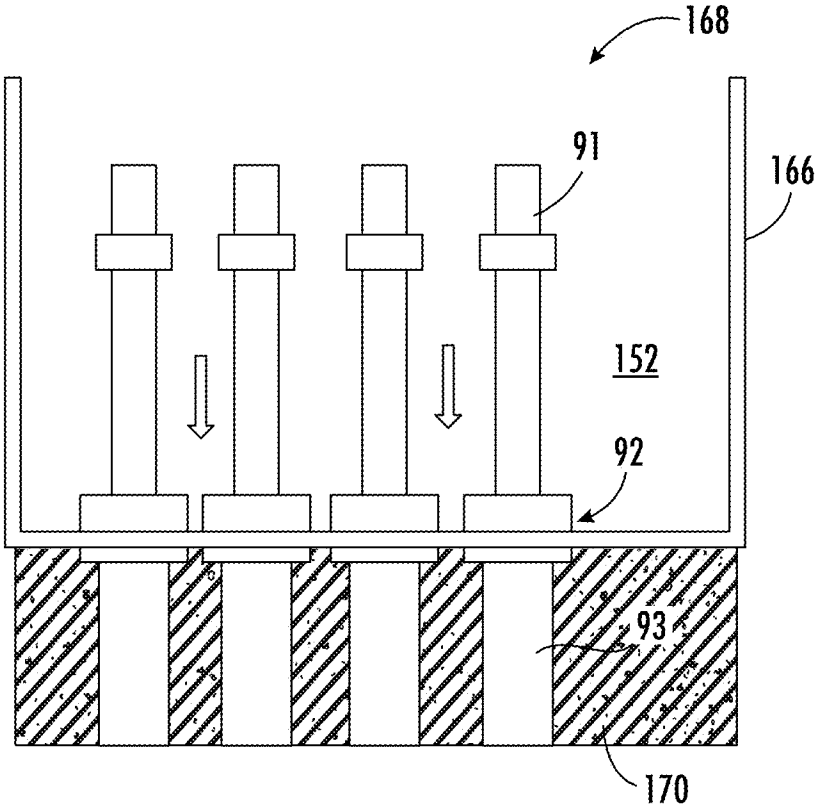
FIG. 12A provides an assembled view of an exemplary valve assembly to an exemplary portion of a door in accordance with aspects of the present disclosure.

Referring briefly to FIGS. 12A-12B, in some embodiments, the conduit 90 may include two or more separable portions. For instance, the conduit 90 may include the tube body 93 extending through the keyway 172. The tube body 93 may be assembled into the door 138 (e.g., a pre-foam door) and retained in the keyway 172. In various embodiments, the seal 170 may form a sealing cover to seal or mitigate fluid communication through the keyway 172 by obscuring the keyway to prevent leakage. Embodiments of the door 138 may be formed through a foaming process with the valves 110 pre-preinstalled to match a position of the valves 110 to the conduits 90.

The conduit 90 may include a separable terminal end 91 forming an over-molded fitting extendable into the tube body 93. A gap between a flange at the terminal end 91 and the tube body 93 may form the retention groove 92 therebetween. For instance, the tube body 93 may form an inner diameter allowing the terminal end 91 to extend into the tube body 93.

In an exemplary embodiment of the refrigerator appliance 10 and valve assembly 100, the valve assembly 100 may include three (3) valves 110. A flow channel is provided between the valves, and an end of the flow channel is attached to release fitting 118, such as a quick-release type fitting. Outlet 120 of each valve 110 may further include connection fitting 118 having a quick-release type fitting. Two or more valves 110, such as three valves, or four valves, are positioned in a row adjacent to one another.

In an exemplary embodiment, to remove the valves 110 for service or replacement, the release plate 130 is pulled along the translation axis T (e.g., along the vertical direction V). The release plate 130 applies a force that translates the release fitting 118 to release the valve quick release fittings and permitting the valve assembly 100 to lift away from the conduit 90 and remove from the plenum 152.

Referring to FIGS. 3A-3C, FIGS. 4A-4C, and FIG. 5A-5C, in an embodiment, the plurality of conduits 90 may include a main water supply conduit 94 extending in fluid communication to the valve assembly 100. In various embodiments, the supply conduit 94 may extend through a hinge 139 at the door 138. For instance, the supply conduit 94 may extend directly from a water source (e.g., a water conduit from the residence or building at which the appliance is positioned), without requiring routing through the cabinet of the refrigerator appliance. However, it should be appreciated that the supply conduit 94 may extend from the cabinet or outer casing 16. The outer casing 16 may include a filter (not depicted) through which water is filtered before supplying to the valve assembly 100.

The refrigerator appliance 10 may include a dispenser supply conduit 95 extending from the valve assembly 100 to the dispenser assembly 54, such as to provide water from the valve assembly 100 to the dispenser assembly 54.

The refrigerator appliance 10 may include a first ice maker supply conduit 96 extending from the valve assembly 100 to the ice maker assembly 154, such as to provide water from the valve assembly 100 to the ice maker assembly 154 to produce ice.

The refrigerator appliance 10 may include a second ice maker supply conduit 97 extending from the valve assembly 100 to a second ice maker assembly 154, such as to provide water from the valve assembly 100 to the second ice maker assembly 154 to produce ice separate from the first ice maker assembly.

Embodiments of the refrigerator appliance 10 and valve assembly 100 provided herein may improve time for installing water valves, reduce risk of leakage, facilitate and improve fitment and connection of conduits to the valves, and reduce a quantity of conduits extending through a hinge at the door, and facilitate placement of a plurality of ice maker assemblies and provision of water thereto.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, comprising:

a cabinet and a door attachable to the cabinet, the door configured to allow selective entry to a refrigeration compartment, a freezer compartment, or both, at the cabinet, wherein the door comprises an ice maker apparatus;

a plurality of valves comprising a solenoid and release fitting, wherein a mount member forming a plate couples together the plurality of valves, and wherein the release fitting is configured to articulate along a translation axis to selectively couple the plurality of valves through a valve opening to a plurality of conduits;

a fluid manifold coupling the plurality of valves together in fluid communication; and a release plate comprising an opening through which the plurality of conduits is extendable in selective fluid coupling to the plurality of valves, the release plate comprising a slot into which the mount member extends to couple the mount member to the release plate, wherein the slot extends along the translation axis to permit movement of the release plate relative to the plurality of valves.

2. The refrigerator appliance of claim 1, wherein the release plate comprises a base wall and a sidewall extending therefrom along the translation axis, wherein the opening at the release plate is positioned through the base wall.

3. The refrigerator appliance of claim 2, wherein the slot at the release plate extends through the sidewall.

4. The refrigerator appliance of claim 2, wherein the sidewall comprises a pair of sidewalls, and wherein the fluid manifold extends between the pair of the sidewalls extending from the base wall.

5. The refrigerator appliance of claim 1, wherein the mount member comprises a fastener opening configured to receive a fastener therethrough to couple the mount member to the door.

6. The refrigerator appliance of claim 1, the door comprising a plenum positioned at a bottom end cap, a top end cap, or the ice maker apparatus, wherein the release plate is positioned at the plenum.

7. The refrigerator appliance of claim 1, wherein the plurality of conduits is at least partially retained at a keyway at the door, and wherein a terminal end of the plurality of conduits is positioned at a plenum positioned at the door.

8. The refrigerator appliance of claim 7, wherein the door comprises a housing at which the keyway is positioned, wherein the housing comprises the plenum, and wherein the housing comprises an open face through which the release plate is receivable into the plenum and in fluid communication with the plurality of valves at the release plate.

9. The refrigerator appliance of claim 8, wherein the plurality of conduits extends through the keyway to position the terminal end of the plurality of conduits in the plenum in fluid communication with the plurality of valves at the release plate.

10. The refrigerator appliance of claim 9, wherein the keyway comprises a keyway opening and a keyway slot, wherein the keyway opening permits extension of the plurality of conduits therethrough, and wherein the keyway slot is configured to retain the plurality of conduits when translated along the keyway slot.

11. The refrigerator appliance of claim 10, comprising:

a seal positioned outside of the housing to obscure the keyway opening when the plurality of conduits is positioned in the keyway slot.

12. The refrigerator appliance of claim 11, wherein the seal comprises a foam body positioned adjacent to the housing outside of the plenum.

13. The refrigerator appliance of claim 1, wherein the door comprises a bottom end cap, and wherein the plurality of valves is positioned at the bottom end cap.

14. The refrigerator appliance of claim 1, wherein the door comprises a top end cap, and wherein the plurality of valves is positioned at the top end cap.

15. The refrigerator appliance of claim 1, wherein the plurality of valves is positioned at the ice maker apparatus.

16. The refrigerator appliance of claim 1, wherein at least one of the plurality of valves is fluidly coupled to a dispenser supply conduit of the plurality of conduits, wherein the dispenser supply conduit is configured in fluid communication from the plurality of valves to the ice maker apparatus.

17. The refrigerator appliance of claim 16, wherein at least one of the plurality of valves is fluidly coupled to an ice maker supply conduit of the plurality of conduits, wherein the ice maker supply conduit is configured in fluid communication from the plurality of valves to the ice maker apparatus.

18. The refrigerator appliance of claim 17, wherein at least one of the plurality of valves is fluidly coupled to a second ice maker supply conduit of the plurality of conduits.

19. A refrigerator appliance, comprising:

a cabinet and a door attachable to the cabinet, the door configured to allow selective entry to a refrigeration compartment, a freezer compartment, or both, at the cabinet, wherein the door comprises an ice maker apparatus;

a plurality of valves comprising a solenoid and release fitting, wherein a mount member couples together the plurality of valves, and wherein the release fitting is configured to articulate along a translation axis to selectively couple the plurality of valves through a valve opening to a plurality of conduits;

a fluid manifold coupling the plurality of valves together in fluid communication; and a release plate comprising a plurality of openings corresponding to the plurality of valves, wherein the plurality of conduits are extendable through the plurality of openings in selective fluid coupling to the plurality of valves, the release plate comprising a slot into which the mount member extends to couple the mount member to the release plate, wherein the slot extends along the translation axis to permit movement of the release plate relative to the plurality of valves.

* * * * *